United States Patent [19]

Hawkins

[11] 4,197,795

[45] Apr. 15, 1980

[54] PRESS OPERATING MECHANISM

[76] Inventor: Wallace H. Hawkins, Rte. 7, Old Buncombe Rd., Greenville, S.C. 29609

[21] Appl. No.: 5,223

[22] Filed: Jan. 22, 1979

[51] Int. Cl.[2] ..... B30B 15/06

[52] U.S. Cl. ..... 100/257; 29/251

[58] Field of Search ..... 100/257, 258 A, 258 R; 29/251; 254/89 R, 89 H, 93

[56] References Cited

U.S. PATENT DOCUMENTS

| | | | |
|---|---|---|---|
| 1,571,622 | 2/1926 | Briggs | 100/257 |
| 1,650,818 | 11/1927 | Buffington | 100/257 |
| 3,283,699 | 11/1966 | Hawkins | 100/257 X |
| 3,307,830 | 3/1967 | Van Allen | 254/93 |

FOREIGN PATENT DOCUMENTS

| | | | |
|---|---|---|---|
| 319383 | 12/1970 | Sweden | 100/257 |

*Primary Examiner*—Billy J. Wilhite

*Attorney, Agent, or Firm*—Bailey, Dority & Flint

[57] ABSTRACT

Apparatus is illustrated for raising and lowering the bed of a press having a fluid operated jack mechanism for engaging work carried by the bed of the press. The apparatus includes a fluid operated ram carried by one of the standards or legs of the press having pivotal connection with one end of the bed and cable and pulley mechanism connecting the other end of the press for raising and lowering the bed preparatory to fixing same in an adjusted vertical position, maintaining same in level condition at all times.

2 Claims, 2 Drawing Figures

Fig. 1.
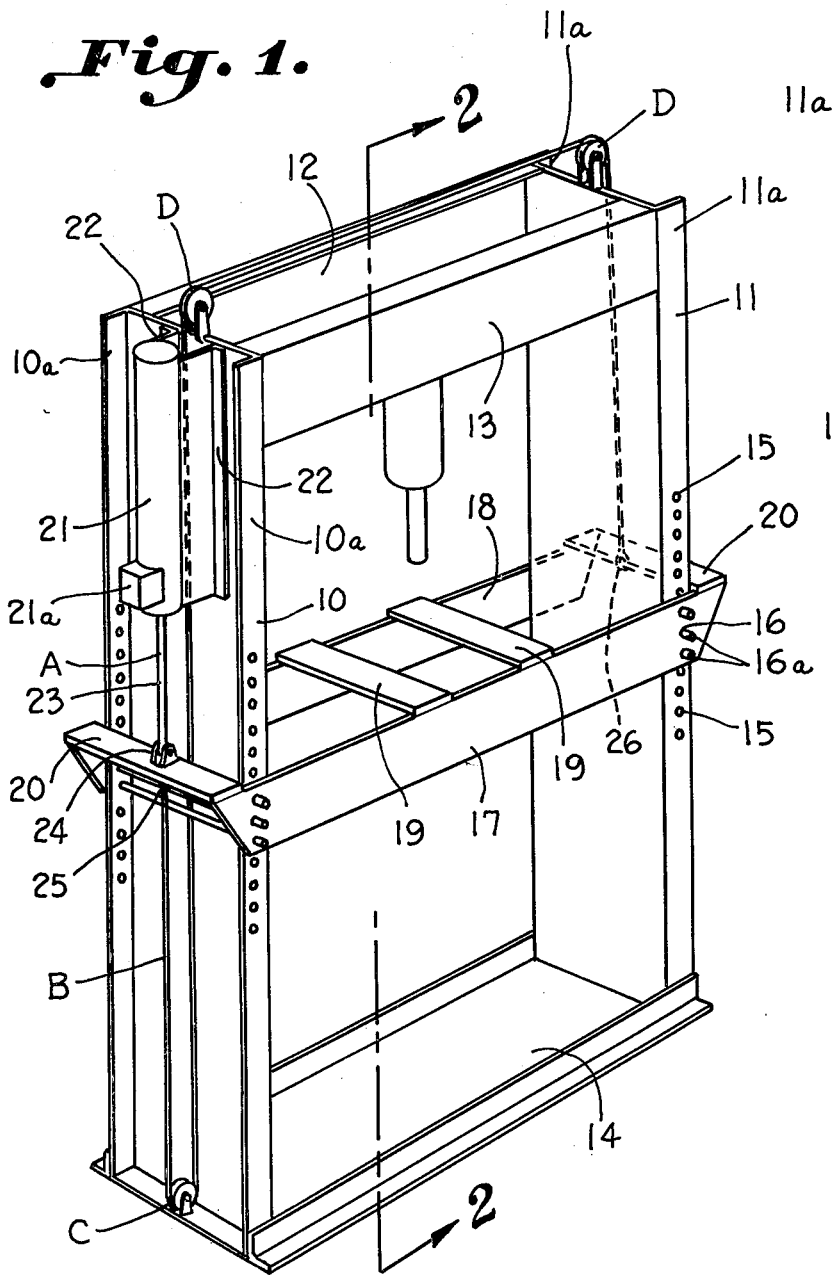
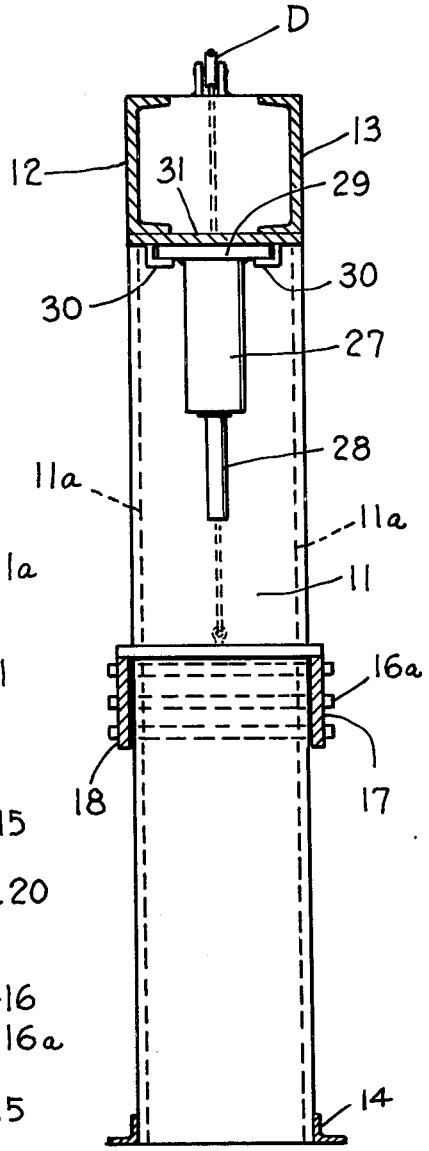
Fig. 2.

PRESS OPERATING MECHANISM

BACKGROUND OF THE INVENTION

The press of the present invention is of the same general type as that illustrated in U.S. Pat. No. 3,283,699. The press generally encompasses a pair of spaced vertical standards bridged at the top and bottom and carrying a bed which is vertically adjustable in horizontal position between the standards and being fixed in adjusted position by passing pins through downwardly extending flanges of the bed and aligned openings in the vertical standards for maintaining the bed of the press in rigid position in adjusted desired locations vertically of the standards. Several pins are passed through each side of the bed and each standard in order to resist the force exerted by the jack or ram member thereof which is hydraulically lowered against the work carried by the press bed or table.

It has been a problem to raise and lower the bed since such are very heavy and various attempts have been made to solve this problem in the past. Such an attempt to provide structure for raising and lowering the bed of a similar press is illustrated in U.S. Pat. No. 3,307,803. In this patent, a windlass arrangement is provided adjacent each side of the press for raising and lowering the bed. The present invention concerns the positioning of a ram adjacent one side of the bed to impart upward or downward movement thereto which may be transmitted through a cable means to the other side of the press for raising or lowering same equally.

BRIEF DESCRIPTION OF THE INVENTION

It has been found that simplified apparatus may be provided for operating the bed of a hydraulic press which may be inexpensively and positively controlled by providing a ram attached to one end of the bed and transmitting commensurate movement imparted by the ram on one side of the bed through a cable to the other side of the bed.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein:

FIG. 1 is a perspective view illustrating a press having apparatus for raising and lowering the bed constructed in accordance with the present invention, and FIG. 2 is a transverse sectional elevation taken on the line 2—2 in FIG. 1.

DESCRIPTION OF A PREFERRED EMBODIMENT

The drawing illustrates a press having a pair of spaced vertical standards carrying a horizontal bed positionable at selected elevations on the standards. Means for raising and lowering the bed includes a fluid operated ram A carried adjacent one of the standards in alignment therewith and having connection adjacent one end of the bed. Cable B is connected adjacent one end of the bed. First pulley C, about which the cable is passed, is carried adjacent one of the standards. A pair of spaced pulleys D are carried adjacent respective standards over which the cable passes for connection adjacent the other end of the bed. Thus, force exerted by the ram against one end of the bed is transmitted to the other end producing commensurate movement thereof maintaining alignment of the bed for positioning same at a selected elevation.

Referring more particularly to the drawing, a pair of spaced vertical standards or legs are illustrated at 10 and 11. The standards are bridged at the top by a pair of inwardly facing channel members 12 and 13. The channel members forming the standards 10 and 11 have outwardly extending flanges 10*a* and 11*a*, respectively. The standards 10 and 11 are bridged at the bottom by a suitable base support 14. The standards on each side have aligned holes 15 passing through respective legs 10*a* and 11*a* and through holes 16 which are aligned in the downwardly extending flanges 17 and 18 which form, together with transverse supports 19, the bed which also has transverse supports 20 adjacent its ends. The ram A has a suitable fluid operated cylinder 21 which has spaced base supports 22 for positioning same upon the outside of the standard 10 between the outwardly extending legs 11*a*. The piston rod 23 of the ram A has pivotal connection as at 24 with one end of the bed and a cable B has connection as at 25 with a lower side of that end of the bed and passes over a pulley C and thence over the pulleys D passing across the top of the press and downwardly for attachment as at 26 adjacent the other side of the press.

It has been found preferably in connection with the fluid operated cylinder and ram arrangement, to utilize air over hydraulic with a modulating control valve 21*a* so as to make it possible to move the bed up and down at a slow control rate so that it may be stopped at any location without being bounced and jerked violently as sometimes occurs when air is the fluid media.

The jack or ram of the press is located between the inwardly extending opposed legs of the channels 10 and 11 and is illustrated as including a hydraulic jacking arrangement 27 carrying a ram 28 for engaging the work. A base member 29 of the jack slides within inturned flanges 30 for movement within the press between the vertical standards. A plate 31 carries the flange members 30 therebeneath.

By thus positioning the cable centrally of the press the adjusting of the vertical positioning thereof is greatly simplified. The pins 16*a* may be inserted through aligned openings 15 and 16 at respective sides of the press with greater facility due to automatic alignment of the press bed. The ram cylinder 21 is spaced from the adjacent standard so that the cable may pass between the ram and the press.

While a preferred embodiment of the invention has been described using specific terms, such description is for illustrative purposes only, and it is to be understood that changes and variations may be made without departing from the spirit or scope of the following claims.

What is claimed is:

1. In a press having a pair of spaced vertical standards carrying a horizontal bed positionable at selected elevations on said standards, means for raising and lowering said bed comprising:

power operated means carried adjacent one of said standards in alignment therewith having connection adjacent one end of said bed;

a cable connected adjacent said one end of said bed;

a first pulley about which said cable is passed carried adjacent said one of said standards;

a pair of spaced pulleys carried adjacent respective standards over which said cable passes for connection adjacent the other end of said bed;

whereby force exerted by said power operated means adjacent one end of said bed is transmitted to the other end producing commensurate movement thereof maintaining alignment of said bed for positioning same at a selected elevation.

2. The structure set forth in claim 1 wherein said cable is positioned centrally of said press, and said power operated means is a fluid operated ram spaced from said one of said standards for said cable to pass between said ram and said press.

* * * * *